US008137085B2

(12) United States Patent
Ni et al.

(10) Patent No.: US 8,137,085 B2
(45) Date of Patent: Mar. 20, 2012

(54) GEAR PUMP WITH SLOTS IN TEETH TO REDUCE CAVITATION

(75) Inventors: Weishun Ni, Rockton, IL (US); Steven A. Heitz, Rockford, IL (US); Joseph Wetch, Roscoe, IL (US); Christian L. Griffiths, Belvidere, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 518 days.

(21) Appl. No.: 12/337,868

(22) Filed: Dec. 18, 2008

(65) Prior Publication Data

US 2010/0158739 A1 Jun. 24, 2010

(51) Int. Cl.
*F03C 4/00* (2006.01)
*F04C 15/00* (2006.01)
*F04C 2/00* (2006.01)

(52) U.S. Cl. ..... 418/190; 418/189; 418/206.5

(58) Field of Classification Search ..... 418/189, 418/190, 206.1, 206.5; 74/409, 460, 461
See application file for complete search history.

(56) References Cited

U.S. PATENT DOCUMENTS

| | | | | | |
|---|---|---|---|---|---|
| 1,633,793 | A | * | 6/1927 | Porst | 418/190 |
| 1,686,867 | A | * | 10/1928 | Kuhn | 418/190 |
| 1,728,528 | A | * | 9/1929 | Butler | 418/190 |
| 2,845,031 | A | * | 7/1958 | Guibert | 418/190 |
| 3,469,531 | A | * | 9/1969 | Wood | 418/206.5 |
| 3,953,160 | A | * | 4/1976 | Bottoms | 418/190 |
| 4,729,727 | A | | 3/1988 | Aarestad | |
| 5,108,275 | A | | 4/1992 | Sager | |
| 5,114,325 | A | | 5/1992 | Morita | |
| 6,149,415 | A | | 11/2000 | Thompson | |
| 6,893,240 | B2 | | 5/2005 | Bush | |
| 6,988,877 | B2 | | 1/2006 | Bush | |
| 7,040,870 | B2 | | 5/2006 | Nicolas | |
| 7,094,042 | B1 | | 8/2006 | Borgetti | |
| 7,153,111 | B2 | | 12/2006 | Bush | |
| 7,335,005 | B2 | | 2/2008 | Cottais | |

* cited by examiner

*Primary Examiner* — Theresa Trieu
(74) *Attorney, Agent, or Firm* — Carlson, Gaskey & Olds, PC

(57) ABSTRACT

A gear pump comprises a drive gear being mounted for rotation about a first axis and having a plurality of gear teeth at a radially outer location. A driven gear is mounted for rotation about a second axis, and having a plurality of teeth at a radially outer location. The drive gear teeth engage the driven gear teeth at a contact face to cause the driven gear to rotate. Slots are formed in the contact face of one of the drive and driven gear teeth.

14 Claims, 2 Drawing Sheets

GEAR PUMP WITH SLOTS IN TEETH TO REDUCE CAVITATION

BACKGROUND OF THE INVENTION

This application relates to a gear pump, wherein slots are cut into the gear teeth to reduce the effect of cavitation.

Gear pumps are known, and typically include a pair of gears mounted for rotation along parallel axes in a housing. One gear is driven by a source of drive to rotate, and gear teeth on the drive gear engage gear teeth on a driven gear. As the drive gear rotates, its gear teeth contact and drive the driven gear. Fluid is entrained in pockets at the outer periphery of both the drive and driven gears, and caused to move from an inlet to an outlet. The gear teeth from the two gears engage at a central location.

Inter-tooth trapped volumes at the central location raise challenges with regard to the design of a gear pump. In particular, there is a concern with cavitation at this location.

Attempts have been made to address this cavitation problem, and in particular, have included tapping a flow of pressurized fluid through one of the gears, and into the inter-tooth trapped volumes. These solutions have been somewhat complex.

SUMMARY OF THE INVENTION

A gear pump comprises a drive gear being mounted for rotation about a first axis and having a plurality of gear teeth at a radially outer location. A driven gear is mounted for rotation about a second axis, and has a plurality of teeth at a radially outer location. The drive gear teeth engage the driven gear teeth at a contact face to cause the driven gear to rotate. Slots are formed in the contact face of one of the drive and driven gear teeth.

These and other features of the present invention can be best understood from the following specification and drawings, the following of which is a brief description.

DETAILED DESCRIPTION OF THE PREFERRED EMBODIMENT

Figure 1:
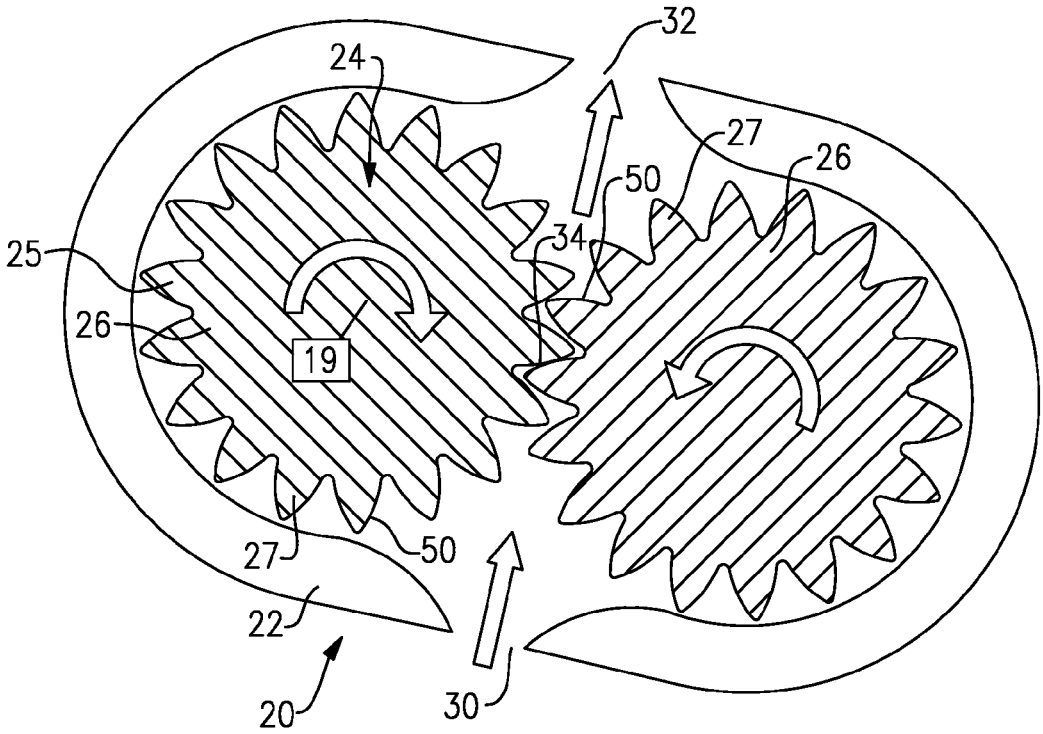
FIG. 1 schematically shows a gear pump.

A gear pump 20 illustrated in FIG. 1 includes a housing 22. A drive gear 24, including gear teeth 25, is mounted within the housing 22. As known, a source of drive 19, shown schematically, causes the drive gear 24 to rotate about an axis.

The gear teeth 25 on the drive gear 24 engage gear teeth 27 on a driven gear 26. The driven gear 26 is caused to rotate, and fluid is moved from an inlet 30 to an outlet 32 in pocket volumes defined between the adjacent gear teeth 27 and 25 at an outer periphery. At the same time, fluid is received in a series of inter-tooth trapped volumes 34 at a generally central location between the drive 24 and driven 26 gears. There is a concern with cavitation at these inter-tooth volumes 34.

A plurality of slots 50 are provided at radial locations on a contact face of the gear teeth 27 of the driven gear 26. The slots 50 are at or near a center of a width of the gear teeth. While the slots 50 are in the driven gear teeth 27, the invention could also extend to slots formed in the drive gear teeth 25.

The slots 50 receive fluid from outlet 32 pulsed into the trapped volume to reduce cavitation.

Figure 2:
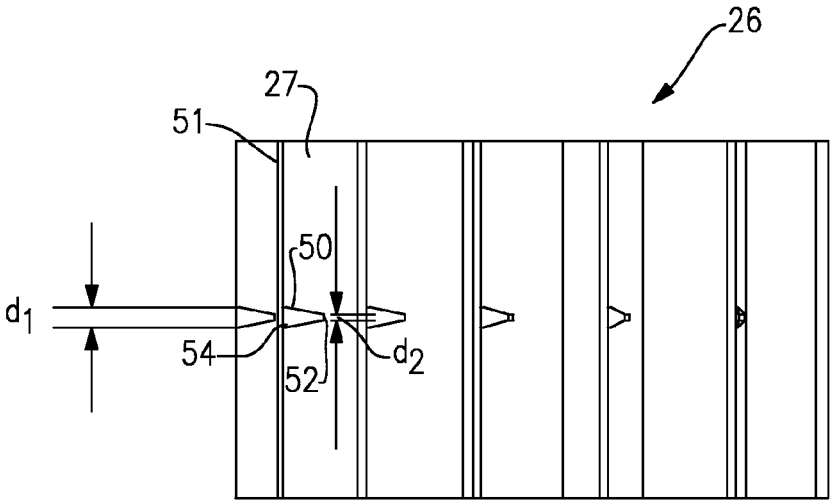
FIG. 2 is a top view of a gear pump incorporating the present invention.

As shown in FIG. 2, the slots 50 have a greater width d1 at a tip 51 of the gear teeth 27 than they do at a radially innermost end 52. The width d1 at the radial outer portion is more than twice the width d2 at the radial inner portion. In one embodiment, the width d1 is four times the width at d2. As can be appreciated, the side surfaces 54 of the slots 50 extend toward each other, relative to an axis of rotation of the driven gear 26, such that the shape of a slot 50 is generally a wedge in this plane.

Figure 3:
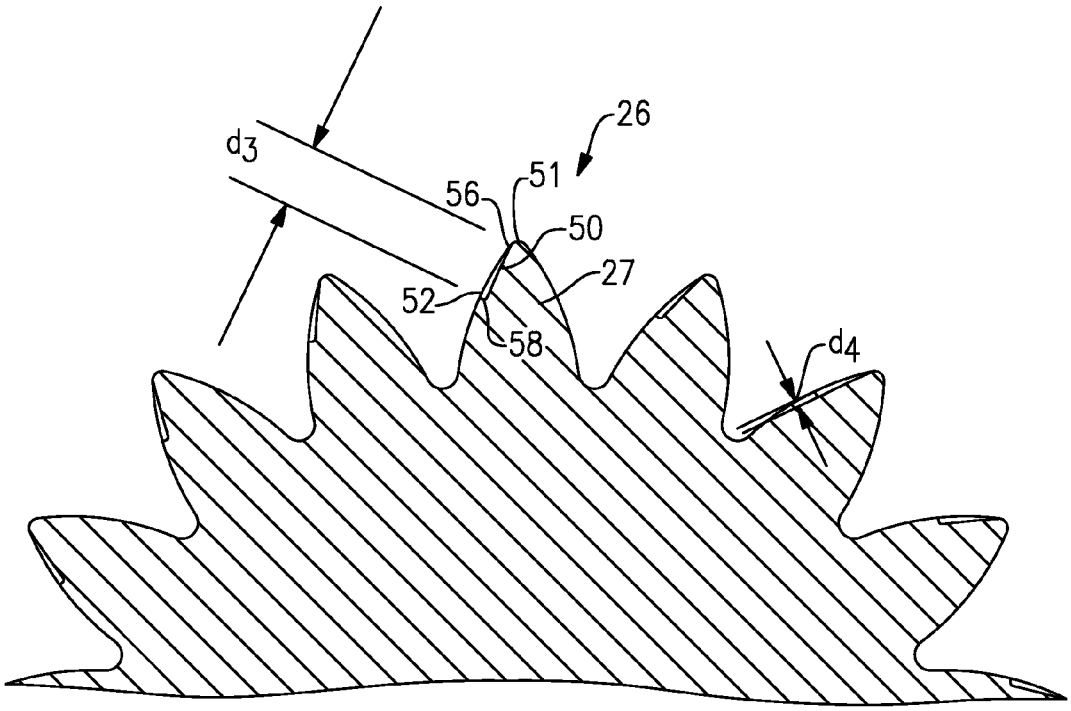
FIG. 3 is a cross-sectional view through a gear pump incorporating the present invention.

FIG. 3 is a cross-sectional view through a driven gear 26 and shows the slot 50 along another plane. As can be seen, the slot 50 is also generally wedge shaped in this plane. A depth 56 at the radially outermost location 51 of the slot 50 is much shallower than a depth 58 at the radially innermost end 52. The position of 52 of the slot 50 is located at gear pitch diameter circumference. The slot 50 extends for a length d3 which is greater than the width d1, and may be more than 1.5 times the width d1. In one embodiment, the length d3 is approximately twice the width d1. d3=(the gear outer diameter−pitch diameter)/2.

At the same time, the depth d4 at the radially innermost end 52 is less than the width d2, and much less than the length d3. As an example, the depth d4 may be approximately 5 to 10% of the length d3. In one embodiment, d1 is close to 5 to 10% of a gear width and d2 is equal to half of d1.

With the slots 50, as the driven gear 26 rotates, fluid from the outlet port 32 is able to move into the inter-tooth volumes 34 through the slots 50. The wedge shape of the slots 50 functions similar to an orifice to channel and force fluid to pressurize into the inter-tooth volumes 34. Cavitation will be reduced.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A gear pump comprising:

a drive gear being mounted for rotation about a first axis, said drive gear having a plurality of gear teeth at a radially outer location;

a driven gear, said driven gear being mounted for rotation about a second axis, said driven gear including a plurality of teeth at a radially outer location, and said drive gears teeth engaging said driven gear teeth at mating contact faces to cause said driven gear to rotate; and slots formed in said contact face of one of said drive and driven gear teeth;

said slots extending from the radially outer location to a radially innermost end relative to one of said first and second axes;

a width of said slots being defined measured along said one of said firsts and second axes, with said width decreasing moving from said radially outer location toward said radially innermost end; and said width at said radially outer location being more than twice said width at said radially innermost end.

2. The gear pump as set forth in claim 1, wherein said one of said drive and driven gear teeth is said driven gear teeth, and said one of said first and second axes is said second axis.

3. The gear pump as set forth in claim 2, wherein a depth of said slot is defined as a dimension extending into said contact face of said gear teeth of said driven gear, and said depth increasing from said radially outer location toward said radially innermost end.

4. The gear pump as set forth in claim 1, wherein said slots extend from a tip of said driven gear teeth radially inwardly.

5. The gear pump as set forth in claim 1, wherein a depth of said slot is defined as a dimension extending into said contact face of said gear tooth of said driven gear, and said depth increasing from said radially outer location toward said radially innermost end.

6. The gear pump as set forth in claim 5, wherein a length of said slot is measured as a distance between said radially outer location and said radially innermost end, and said length being greater than said width at said radially outer location.

7. The gear pump as set forth in claim 6, wherein a ratio of said length to said width at said radially outer location is greater than 1.5.

8. The gear pump as set forth in claim 1, wherein a depth of said slot is defined as a dimension extending into said contact face of said gear tooth of said driven gear, and said depth increasing from said radially outer location toward said radially innermost end.

9. The gear pump as set forth in claim 8, wherein a length of said slot is measured as a distance between said radially outer location and said radially innermost end, and said length being greater than said width at said radially outer location.

10. The gear pump as set forth in claim 9, wherein a ratio of said length to said width at said radially outer location is greater than 1.5.

11. A gear pump comprising:

a drive gear being mounted for rotation about a first axis, said drive gear having a plurality of gear teeth at a radially outer location;

a driven gear, said driven gear being mounted for rotation about a second axis, said driven gear including a plurality of teeth at a radially outer location, and said drive gears teeth engaging said driven gear teeth at mating contact faces to cause said driven gear to rotate; and slots formed in said contact face of one of said drive and driven gear teeth;

said slots extending from the radially outer location to a radially innermost end relative to one of said first and second axes;

a width of said slots being defined measured along said one of said firsts and second axes, with said width decreasing moving from said radially outer location toward said radially innermost end;

said one of said drive and driven gear teeth is said driven gear teeth, and said one of said first and second axes is said second axis; and a length of said slot being measured as a distance between said radially outer location and said radially innermost end, and said length being greater than said width at said radially outer location.

12. The gear pump as set forth in claim 11, wherein a ratio of said length to said width at said radially outer location is greater than 1.5.

13. The gear pump as set forth in claim 11, wherein said width at said radially outer location is more than twice said width at said radially innermost end.

14. A gear pump comprising:

a drive gear being mounted for rotation about a first axis, said drive gear having a plurality of gear teeth at a radially outer location;

a driven gear, said driven gear being mounted for rotation about a second axis, said driven gear including a plurality of teeth at a radially outer location, and said drive gears teeth engaging said driven gear teeth at mating contact faces to cause said driven gear to rotate;

slots formed in said contact face of said driven gear teeth;

said slots extend from a radially outer location to a radially innermost end relative to said second axis, a width of said slots defined measured along said second axis, with said width decreasing moving from said radially outer location toward said radially innermost end, said width at said radially outer location is more than twice said width at said radially innermost end;

a depth of said slot defined as a dimension extending into said contact face of said gear tooth of said driven gear, and said depth increasing from said radially outer location toward said radially innermost end; and a length of said slot measured as a distance between said radially outer location and said radially innermost end, and said length being greater than said width at said radially outer location, a ratio of said length to said width at said radially outer location is greater than 1.5.

* * * * *